US005967059A

United States Patent [19]

Jensen

[11] Patent Number: 5,967,059

[45] Date of Patent: Oct. 19, 1999

[54] HEIGHT-ADJUSTABLE WORK BENCH

[75] Inventor: Kim Fjellø Jensen, Svendborg, Denmark

[73] Assignee: SIS human factor technologies, inc., Londonderry, N.H.

[21] Appl. No.: 09/005,641

[22] Filed: Jan. 9, 1998

[30] Foreign Application Priority Data

Jan. 9, 1997 [DK] Denmark ..... 00008/97

[51] Int. Cl.[6] ..... A47B 9/00

[52] U.S. Cl. ..... 108/147; 108/145

[58] Field of Search ..... 108/147, 145; 248/421, 420

[56] References Cited

U.S. PATENT DOCUMENTS

| | | | |
|---|---|---|---|
| 2,170,098 | 8/1939 | Stephenson | 108/145 X |
| 2,531,140 | 11/1950 | Linde | 108/145 X |
| 2,630,359 | 3/1953 | Schade | 108/145 X |
| 3,623,168 | 11/1971 | Rouch | 108/145 X |
| 3,805,712 | 4/1974 | Taylor et al. | 108/145 X |
| 5,476,050 | 12/1995 | Zimmer et al. | 108/145 |

*Primary Examiner*—Jose V. Chen
*Attorney, Agent, or Firm*—Paul C. Remus, Esquire; Kristin Kohler, Esquire; Devine, Millimet & Branch, P.A.

[57] ABSTRACT

A stable work bench (1) that is easy to adjust in height regardless of the load on the platform (8) has an upper platform (2) and a lower base element (3), a frame that is variable in height and arranged between the platform (2) and the base element (3), each end of which frame has an upright first leg (4) and a second leg (5) disposed parallel thereto and at a horizontal distance therefrom that supports the underside of the platform (2), which legs (4, 5) are pivotably connected by a lower arm (6) and an upper arm (7) parallel thereto to produce a deformable parallelogram (4–7), and with a drive system to raise and lower the platform (2) of the work bench (1) by changing the angle between the parallel arms (6, 7) and the upright first leg (4). The novelty thereof consists in that the platform (2) is mounted displaceably in relation to the second leg (5) and transversely to the plane of the parallelogram (4–7), that the parallelogram (4–7) includes a plate (8) with an oblong, non-linearly recess (9) that accommodates a slide (12) that is connected to the parallelogram (4–7) in such a way that a change in the angle between the parallel arms (6,7) and the upright first leg (4) results in displacement of the slide (12) along the recess (9), as well as movement of the slide (12) in the plane of the plate (8) and transversely to the recess (9), and in that the movement of the slide (12) is transferred to displace the platform (2) so that it alone is raised or lowered vertically.

9 Claims, 2 Drawing Sheets

HEIGHT-ADJUSTABLE WORK BENCH

RANGE OF APPLICATION OF THE INVENTION

Figure 1:
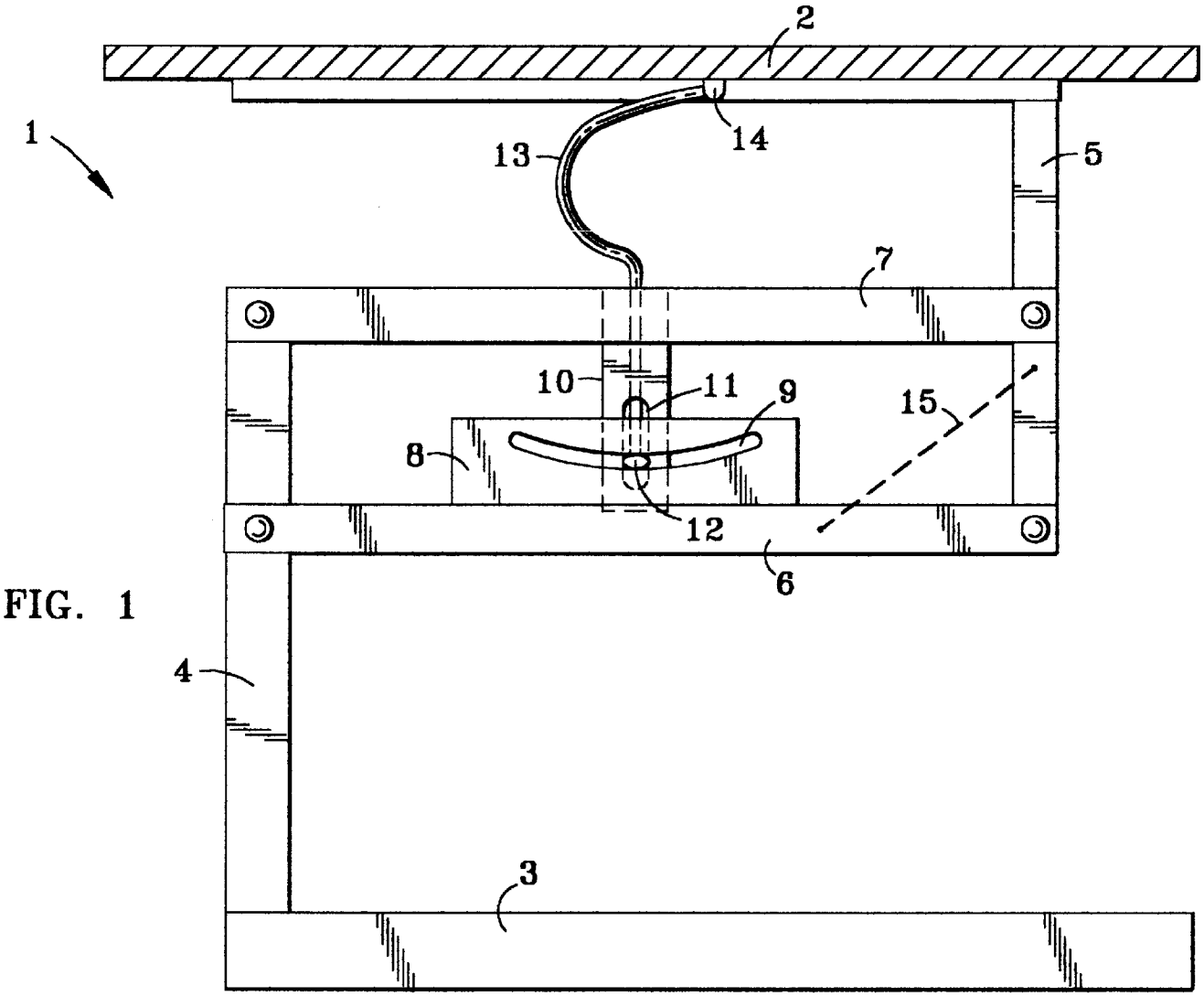

This invention concerns a height-adjustable work bench with an upper platform and a lower base element, a frame that is variable in height and arranged between the platform and the base element, each end of which frame has an upright first leg and a second leg disposed parallel thereto and at a horizontal distance therefrom that supports the underside of the platform, which legs are pivotably connected by means of a lower arm and an upper arm parallel thereto to produce a deformable parallelogram, and with a drive mechanism to raise and lower the platform of the work bench by changing the angle between the parallel arms and the upright first leg.

Work benches of this type have been developed for use at work stations where adjustability of the height of a table top or working area is desirable in view of the work being done.

The term "work station" is used in the broadest sense and includes, e.g., writing tables for use as sitting/standing tables in connection with which height adjustability from, e.g., 65 to 125 cm may be desirable.

Assembly stations, welding tables and packaging tables to be used by different operators or in connection with assembly work during which height adjustment is necessary may also be relevant.

The term "platform" is also used in the broadest sense and can thus include special table tops or stands designed to support objects that are to be machined and/or assembled.

KNOWN TECHNIQUE

A change in the height of a work bench of the type discussed in the preamble entails that the platform be displaced to one side so that, in its highest position, the platform extends farther past the lower base element than is the case when the platform is in its lowest position.

TECHNICAL PROBLEM TO BE SOLVED

The work bench described in the preamble is therefore somewhat difficult to use, since the lateral displacement of the platform entails that the work bench must always be placed sufficiently far from a wall that the platform does not encounter the wall when the platform is moved to its highest position. Furthermore, the lateral displacement of the platform entails that any load on the work bench can easily result in an imbalance, since the center of gravity is shifted when the height is adjusted.

PURPOSE OF THE INVENTION

This invention is intended to provide an improved type of work bench that can be placed in close abutment to a wall and cannot be brought into imbalance when the platform height is adjusted.

NEW TECHNIQUE

The novelty of the invention consists in that the platform is mounted displaceably in relation to the second leg and transversely to the plane of the parallelogram, insofar as the parallelogram includes a plate with an oblong, non-linearly running recess that accommodates a slide that is connected to the parallelogram in such a way that a change in the angle between the parallel arms and the upright first leg results in displacement of the slide along the recess, as well as movement of the slide in the plane of the plate and transversely to the recess, and in that the movement of the slide is transferred so as to displace the platform in such a way that it alone is raised or lowered vertically.

In a first embodiment, the novelty consists in that the plate is fixedly attached to the lower arm, the upper arm has a fitting with a longitudinal groove to guide the movement of the slide transversely to the plane of the plate, and in that the movement of the slide in the groove is transferred to the platform by means of a cable that is attached to the platform.

In a preferred second embodiment, the novelty consists in that the plate is connected by means of a hinge to the underside of the platform in proximity to the second leg and on the side facing the first leg, and to the oblong, non-linearly running recess that extends longitudinally along the legs, and in that the slide is fixedly attached to the upper arm in engagement with the oblong, non-linearly running recess.

TECHNICAL OPERATION

The work bench according to either the first or the second embodiment provides a height-adjustable work bench that can be placed in close abutment to a wall without adjustment of its height causing the platform to encounter the wall, and a work bench that cannot be brought into imbalance by changes in the working height of the platform.

The dependent claims describe advantageous embodiments of the work bench according to the invention.

FIGURES

Figure 2:
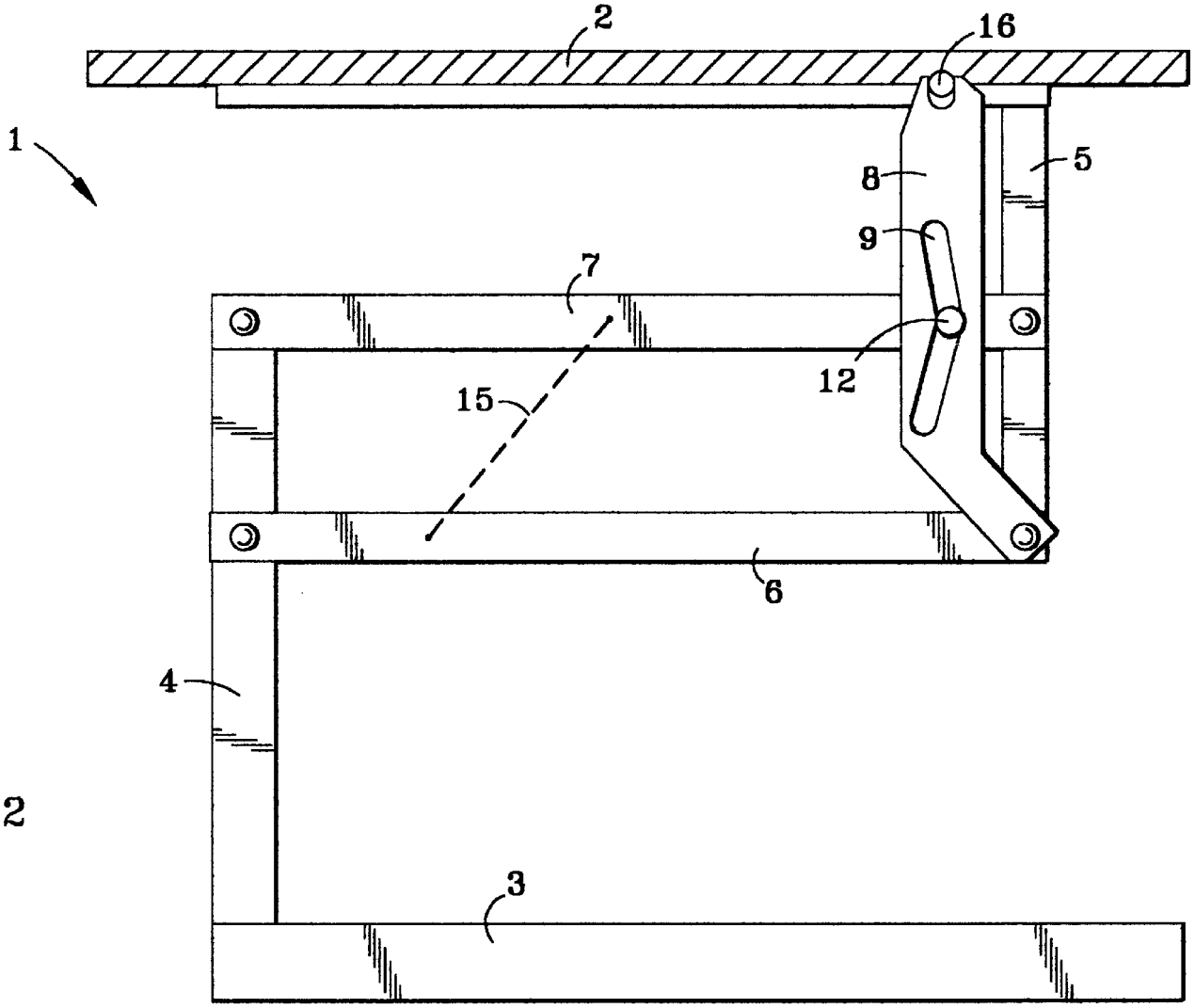

The work bench according to the invention is described in greater detail in the attached drawing, in which:

FIG. 1 shows a side view of a first embodiment of the work bench according to the invention, and FIG. 2 shows a side view of a preferred second embodiment of the work bench according to the invention.

EXEMPLARY EMBODIMENTS

FIG. 1 of the drawing shows a first embodiment of a work bench 1 according to the invention. The bench 1 comprises an upper platform 2 and a lower base element 3, along with a frame arranged between the platform 2 and the base element 3, each end of which frame has an upright first leg 4 and a second leg 5 disposed parallel thereto and at a horizontal distance therefrom that is connected to the underside of the platform 2.

The platform 2 is also arranged displaceably in relation to the second leg 5 and transversely to the plane of the legs 4, 5, which displacement can be achieved by means of wheels that are guided by U-shaped rails on the underside of the platform 2. The wheels and U-shaped rails are not depicted specifically in the drawings, but the rails and wheels would be located on the underside of platform (2) where fitting (14) is shown in FIG. 1 and the wheels would slide back and forth along the length of the underside of platform (2) as does fitting (14) in the drawing.

Between the two legs 4, 5 there extends a lower arm 6 and an upper arm 7 parallel thereto, which arms 6, 7 are pivotably connected to the upright legs 4, 5 so as to produce a deformable parallelogram 4–7.

There is also a drive mechanism in the form of a pneumatic spring that is introduced into the parallelogram 4–7 between, e.g., the lower arm 6 and the second leg 5, which drive mechanism is denoted by a dotted line 15 in FIG. 1. As a result, contraction of the drive mechanism will result in a lowering of the second leg 5, while extension of the drive mechanism will conversely result in a raising of the second leg 5.

The legs 4, 5 and the arms 6, 7 consist of profiled sections that are sufficiently strong to withstand the forces that act on these parts when the work bench 1 is loaded during use.

A plate 8 is fixedly attached to the lower arm 6 and has an oblong, non-linearly running recess 9, insofar as the ends of the recess 9 are disposed a greater distance from the base element 3 than the middle of the recess 9.

A fitting 10 is fixed around the middle of the upper arm 7 and extends toward the plate 8. The fitting 10 has a longitudinal groove 11 to guide a slide 12, which also engages the oblong, non-linearly running recess 9.

The slide 12 is in engagement with a cable 13, the other end of which is secured to a fitting 14 on the underside of the platform 2.

When the configuration of the parallelogram 4–7 is changed by means of the drive mechanism 15, whereby the second leg 5 is either lowered or raised depending on whether the drive mechanism 15 is respectively contracted or extended, the slide 12 will be displaced along the recess 9 and moved upwardly or downwardly in the groove 11. Through the appropriate design of the oblong, non-linearly running recess 9 and proper dimensioning of the length of the fitting 10, the movement of the slide 12 in the groove 11 can be adjusted in such a way that the platform 2 is raised vertically without its being displaced in relation to the base element 3. An force on platform 2 is maintained by the give and take on cable 13 provided by slide 12, groove 11, recess 9 and fitting 14.

FIG. 2 shows a preferred second embodiment of the work bench 1 according to the invention.

An attempt has been made in FIG. 2 to use the same reference designations as were used in FIG. 1, and only the arrangement of the plate 8 with the oblong, non-linearly running recess 9 and the location of the slide 12 differ from the first embodiment.

The plate 8 is connected by means of a hinge 16 to the underside of the platform 2 in proximity to the second leg 5 and on the side facing the first leg 4, and to the oblong, non-linearly running recess 9 that extends longitudinally along the legs 4, 5. The hinge 16 must permit a certain freedom of movement of the plate 8 along the second leg 5 in relation to the platform 2 and the parallelogram 4–7 when the height of the platform 2 is changed, which freedom of movement is achieved by means of an oblong opening in connection with the hinge 16 in the plate 8.

It is necessary to limit the freedom of movement of the plate 8 around its hinge 16, and this is achieved in that one end of the plate 8 is pivotably connected to the hinge 16 between the lower arm 6 and the second leg 5.

The slide 12 is fixedly attached to the upper arm 7 and is in engagement with the oblong, non-linearly running recess 9. The recess 9 is arranged in such a way that its ends are closer to the first leg 4 than the middle of the recess 9.

A change in the angle between the parallel arms 6, 7 and the upright first leg 4 results in displacement of the slide 12 along the recess 9 and movement of the plate 8 along the upper arm 7, which movement is transferred via the hinge 16 to displace the platform 2, so that only said platform 2 is raised or lowered vertically.

A weight-equalizing device that is known per se and not shown in the drawing can be arranged in the parallelogram 4–7 and can consist, e.g., of a gas pressure cylinder of a commonly known type.

I claim:

1. A height-adjustable work bench (1) with an upper platform (2) and a lower base element (3), a frame that is variable in height and arranged between the platform (2) and the base element (3), each end of which frame has an upright first leg (4) and a second leg (5) disposed parallel thereto and at a horizontal distance therefrom that supports the underside of the platform (2), which legs (4, 5) are pivotably connected by means of a lower arm (6) and an upper arm (7) parallel thereto to produce a deformable parallelogram (4–7), and with a drive mechanism to raise and lower the platform (2) of the workbench (1) by changing the angle between the parallel arms (6,7) and the upright first let (4), wherein the platform (2) is mounted displaceably in relation to the second leg (5) and transversely to the plane of the parallelogram (4–7), the parallelogram (4–7) includes a plate (8) disposed on lower arm (6) and having an oblong, non-linear recess (9) that accommodates a slide (12) that is connected to the parallelogram (4–7), means for displacing the slide (12) along the recess (9) such that a change in the angle between the parallel arms (6,7) and the upright first leg (4), during raising and lowering of the platform (2) results in displacement of the slide (12) along the recess (9), as well as movement of the slide (12) in the plane of the plate (8) and transversely to the recess (9), such that the movement of the slide (12) is transferred through said means for displacing the slide (12) to displace the platform (2) so that the platform (2) is kept centered while being raised or lowered vertically.

2. A work bench (1) according to claim 1, wherein the plate (8) is fixedly attached to the lower arm (6), and the upper arm (7) has a fitting (10) with a longitudinal groove (11) to guide the movement of the slide (12) transversely to the plane of the plate (8), when platform (2) is being raised and lowered, wherein the movement of the slide (12) in the groove (11) is transferred to the platform (2) by means of force exerted on a cable (13) and a movable fitting (14) that is attached to the platform (2).

3. A work bench (1) according to claim 1, which is novel in that the oblong, non-linearly running recess (9) is designed so that its ends are closer to the platform (2) than the middle of the recess (9).

4. A height-adjustable work bench (1) according to claim 1, which is novel in that the plate (8) is connected by means of a hinge (16) to the underside of the platform (2) in proximity to the second leg (5) and on the side facing the first leg (4), and to the oblong, non-linearly running recess (9) that extends longitudinally along the legs (4, 5), and in that the slide (12) is fixedly attached to the upper arm (7) in engagement with the oblong, non-linearly running recess (9).

5. A work bench (1) according to claim 4, which is novel in that the oblong, non-linearly running recess (9) is designed so that its ends are closer to the first leg (4) than the middle of the recess (9).

6. A work bench (1) according to claim 2, which is novel in that the oblong, non-linearly running recess (9) is designed so that its ends are closer to the platform (2) than the middle of the recess (9).

7. A work bench (1) according to any of foregoing claims 1–6, wherein the displaceable mounting of the platform (2) consists of wheels that run in U-rails on the underside of the platform (2).

8. A work bench (1) according to any of foregoing claims 1–6, which is novel in that the drive mechanism (15) is a pneumatic spring that is introduced between the elements in the parallelogram (4–7).

9. A work bench (1) according to claim 1, wherein the plate (8) is connected by means of a hinge (16) to the underside of the platform (2) proximate to the second leg (5) and facing the first leg (4), wherein the hinge (16) permits movement of the plate (8) with respect to the second leg (5) and along the upper arm (7), in relation to the platform (2) and the parallelogram (4–7) to maintain centering of the platform (2) while the platform (2) is raised and lowered.

* * * * *